United States Patent [19]

Graham, Jr.

[11] Patent Number: 4,584,806

[45] Date of Patent: Apr. 29, 1986

[54] SYSTEM FOR INTERCONNECTING PANELS

[76] Inventor: Andrew S. Graham, Jr., Laburnum La., Wyncote, Pa. 19095

[21] Appl. No.: 710,492

[22] Filed: Mar. 11, 1985

[51] Int. Cl.[4] ..... E04C 1/10

[52] U.S. Cl. ..... 52/285; 52/584; 52/585; 24/573; 217/65; 217/69

[58] Field of Search ..... 52/285, 271, 584, 585, 52/578; 24/573, 545, 563; 217/65, 69

[56] References Cited

U.S. PATENT DOCUMENTS

| | | | |
|---|---|---|---|
| 2,121,394 | 6/1938 | Carew | 229/47 |
| 2,153,122 | 4/1939 | Powell | 229/5.7 |
| 2,225,592 | 12/1940 | MacFadden | 248/500 |
| 2,590,159 | 3/1952 | Davis | 217/65 |
| 2,896,808 | 7/1959 | Papy et al. | 217/66 |
| 3,082,897 | 3/1963 | Highley | 217/65 |
| 3,113,358 | 12/1963 | Zell et al. | 52/285 |
| 3,323,674 | 6/1967 | Nist | 217/12 |
| 3,468,094 | 9/1969 | Campbell | 52/742 |
| 3,477,184 | 11/1969 | Johnson et al. | 52/105 |
| 3,945,601 | 3/1976 | Rowley | 249/48 |
| 3,990,599 | 11/1976 | Rowley | 217/12 R |
| 4,024,977 | 5/1977 | Rowley | 217/12 R |
| 4,139,113 | 2/1979 | Graham | 217/12 R |
| 4,194,642 | 3/1980 | Glavan | 217/12 R |
| 4,440,363 | 4/1984 | Brand | 25/573 |
| 4,453,471 | 6/1984 | Harrington et al. | 108/55.1 |
| 4,454,694 | 6/1984 | Davanture | 52/285 |
| 4,461,395 | 7/1984 | Burnett | 217/12 R |

FOREIGN PATENT DOCUMENTS

| | | | |
|---|---|---|---|
| 239677 | 4/1960 | Australia . | |
| 621910 | 6/1961 | Canada | 24/573 |
| 1219365 | 5/1960 | France . | |
| 2129040 | 5/1984 | United Kingdom | 403/403 |

*Primary Examiner*—Henry E. Raduazo
*Assistant Examiner*—John Malcolm White
*Attorney, Agent, or Firm*—Charles H. Lindrooth; Kenneth P. Synnestvedt

[57] ABSTRACT

System for interconnecting panels, especially adapted for use in the temporary interconnection of panes of cartons or containers used for shipping or transportation, the arrangement is particularly adapted to the interconnection of panels in edge-to-edge relation where the panels either lie in the same plane or lie in planes extended at angles to each other particularly in a range between the 180 degrees of the common plane relationship and the 90 degree relationship at the corners of common rectangular cartons.

10 Claims, 9 Drawing Figures

SYSTEM FOR INTERCONNECTING PANELS

BACKGROUND AND STATEMENT OF OBJECTS

The present invention is concerned with a system for interconnecting panels, particularly panels of a carton or container where the panels are arranged in edge-to-edge relation either in the same plane or in planes at angles to each other between the same plane (180 degree relationship) and the typical 90 degree relationship at the corners of conventional cartons.

Panel interconnecting systems are well known, especially for the interconnection of panels along the corners or edges of a rectangular carton where the panels extend from each other usually at angles of 90 degrees. Such known fastened systems customarily include connector plates which are fastened to the panels near the 90 degree corner, together with a spring clip extended around the corner and engaging the connector plates. The prior art connection systems of the kind just referred to are not well adapted to the interconnection of panels where the panels lie in the same plane or at some angle to each other greater than the 90 degree angle, which is characteristic of the corners of typical rectangular shipping cartons.

One of the objects of the present invention is to provide a fastening system especially adapted to the interconnection of panels lying in or close to a common plane and providing for snug and secure fastening or interconnection of the panels in a direction across the panel joint, and the arrangement of the invention provides not only for a secure attachment of the panels to each other, but the invention also makes provision for resisting undesired relative shifting movements of the panels in directions paralleling the joint between the panels.

It is a further object of the invention to provide for convenient and simple application of the fastening components and also for ready separation of the joint, thereby contributing to the ease of assembly of shipping cartons and ready separation of the parts for reuse in subsequent packaging.

Still another object of the invention is to provide a system for panel interconnection, especially where the panels lie in the same plane and readily adapted to the interconnection of panels or panel pieces of various different sizes and shapes, so that the same fastening devices can be employed in the assembly of cartons of various sizes and shapes in some of which different numbers of panel pieces are used.

While the arrangement of the invention is of particular advantage in the interconnection of panels lying in a range from 180 degrees to less than 90 degrees, nevertheless the connector of the present invention can also be used for interconnection of panels lying in the conventional 90 degree relationship or even at sharper angular relationships.

It is also to be understood that the fastening device of the present invention is applicable not only to cartons but also to a wide variety of enclosures or the like, such as boxes, containers, vessels, structural partitioning or enclosures, and the use of the term container herein is not to be understood in a limited sense.

BRIEF DESCRIPTION OF DRAWINGS

How the foregoing and other objects and advantages are attained will be clear from the following description referring to the accompanying drawings, in which.

DETAILED DESCRIPTION

Figure 1:
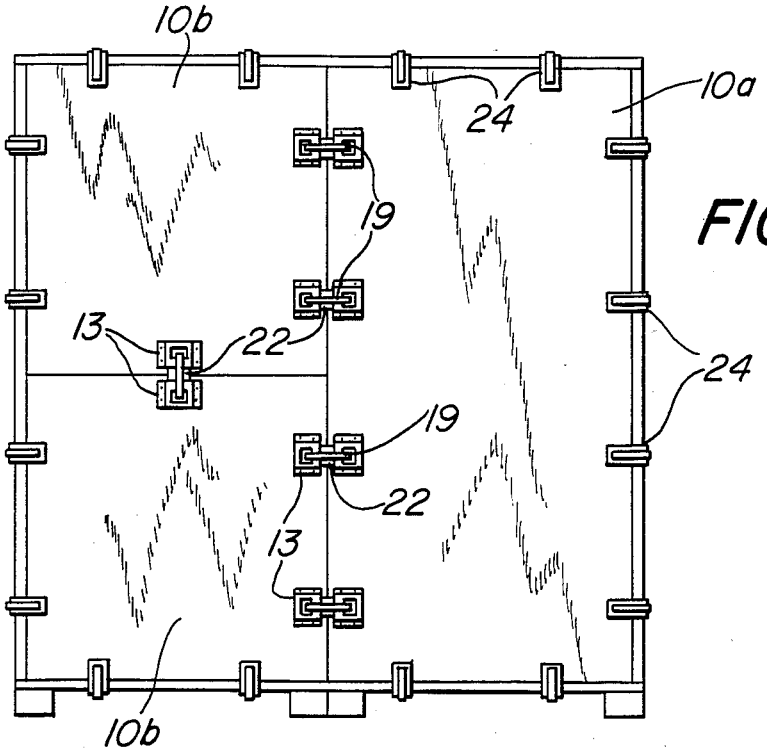
FIG. 1 is an elevational view of one side of a carton in which several panel pieces of different sizes are fastened together by fastening devices of the kind herein disclosed.

Reference is first made to the embodiment illustrated in FIGS. 1 to 6, inclusive. The panels shown as being interconnected in this embodiment are indicated at 10—10. The fastening device of the invention is applicable to panels formed of a variety of materials including metals and plastics, but in most cartons or containers, the panel material comprises wood, either in the form of plain wood slabs or in the form of plywood or wood particle board.

As seen in FIGS. 2 to 6, the panels 10—10 lie in a common plane and meet at a joint 11, the fastening device being associated with the edges of the panels near the joint. Each of the devices for interconnecting the two adjoining panels includes four components comprising a pair of connector plates, one mounted near the edge of each panel, a bridge plate spanning the joint between the panels and a spring clip for holding the parts in assembled relation.

In the drawings, each connector plate is generally indicated by the reference numeral 13. Each connector plate takes the form of a metal channel member 14 having flanges 15 with marginal strips 16 apertured to pass the fastening screws 17 by which the connector plates are secured to the panels.

Figure 2:
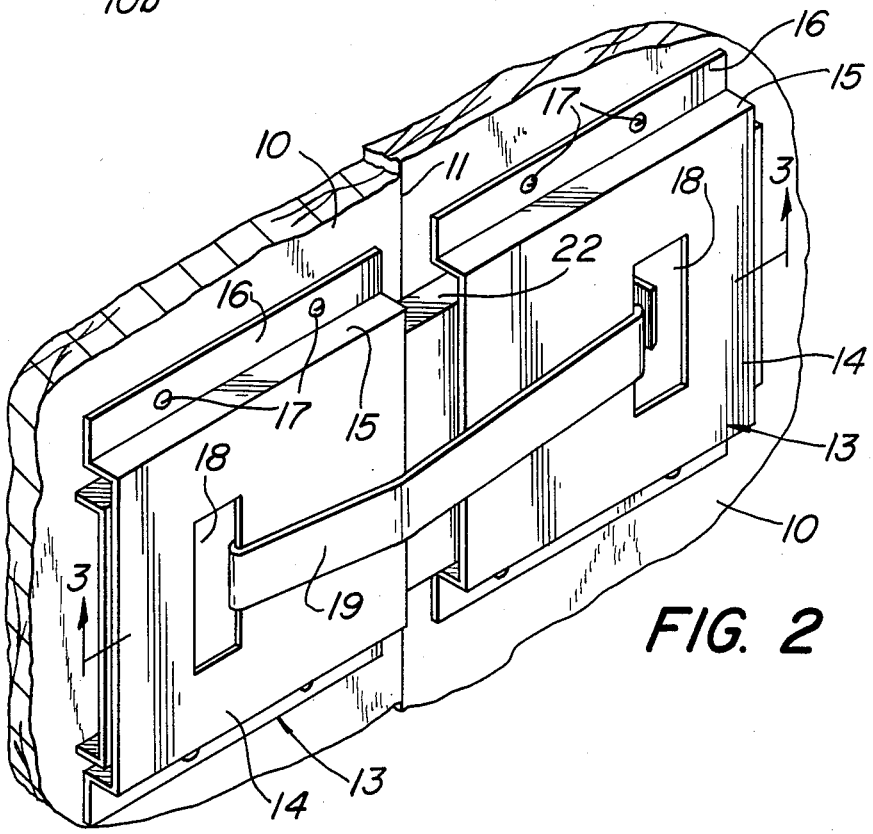
FIG. 2 is a perspective view of fragments of adjoining panels and illustrating a fastening device according to the invention applied thereto.
Figure 3:
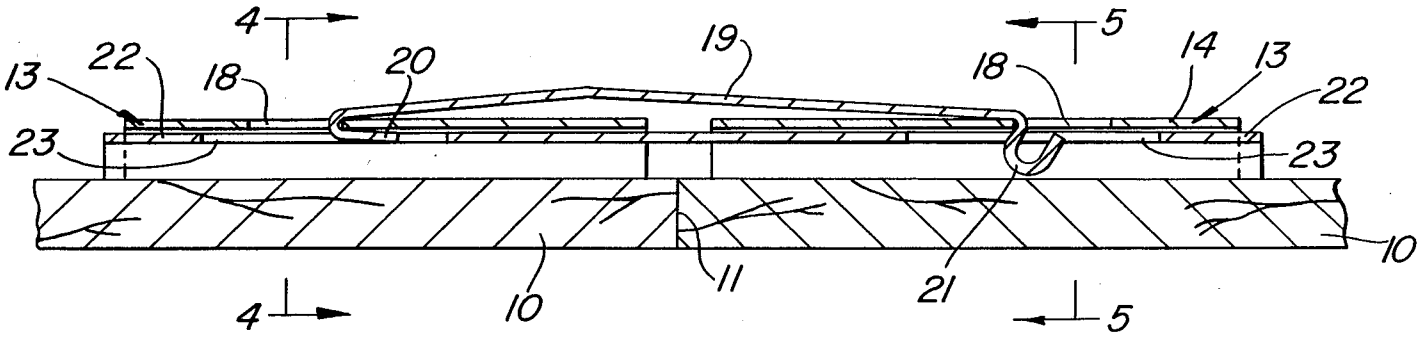
FIG. 3 is a fragmentary transverse sectional view taken as indicated by the section line 3—3 on FIG. 2.
Figure 5:
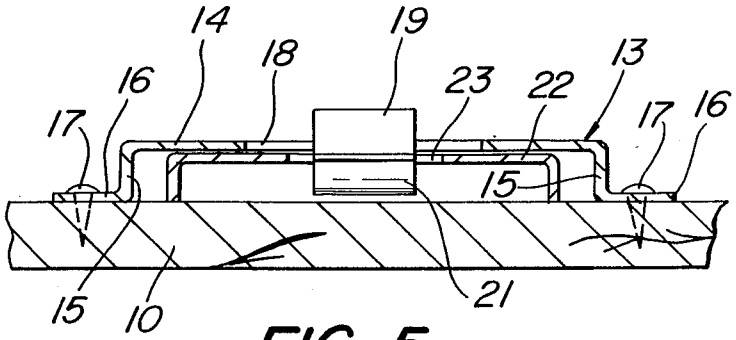
FIGS. 4 and 5 are transverse sectional views taken as indicated by the section lines 4—4 and 5—5 on FIG. 3.
Figure 4:
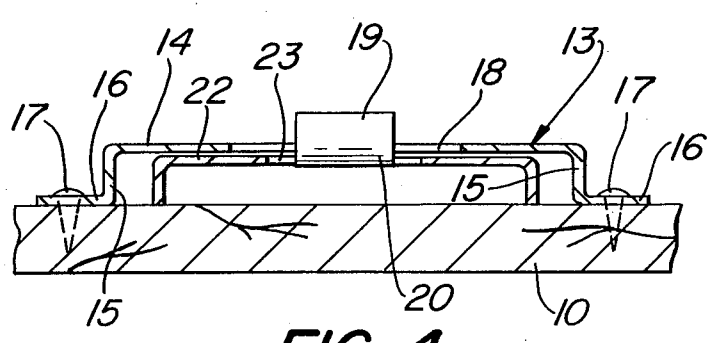
Figure 6:
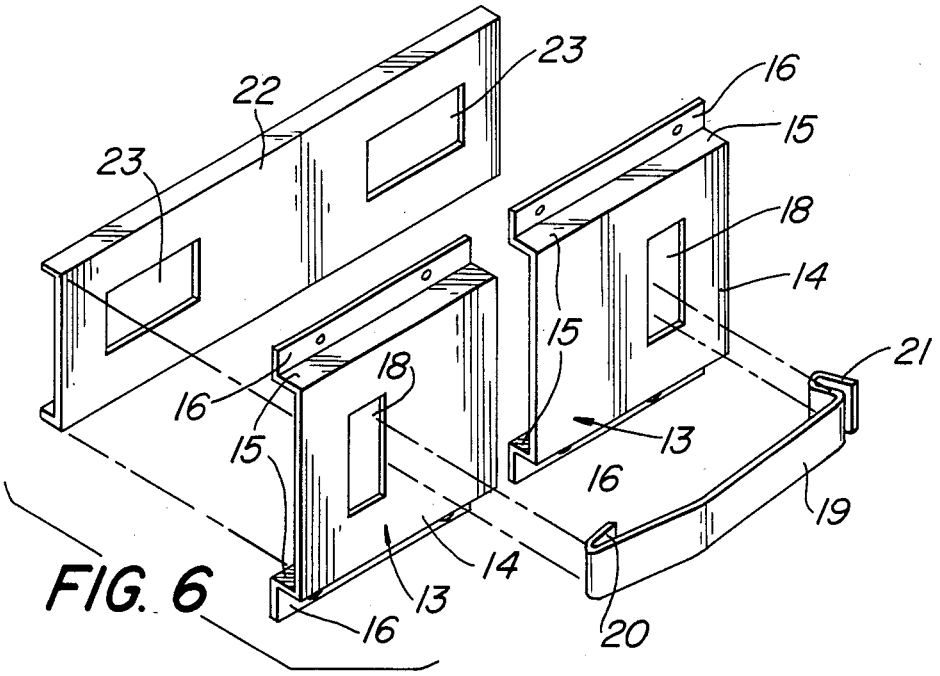
FIG. 6 is a somewhat diagrammatic exploded perspective view of the parts of a fastening device according to the invention.

From the drawings, it will be noted that each connector plate is mounted on the panel in a position so as to define cavities lying along the panel and having openings presented toward each other across the panel joint. Each connector plate also has apertures 18 formed therein and adapted to cooperate with the fastening means provided at the ends of the spring clip 19 which comprises the fastening component of the joint. As shown in FIG. 6, the spring clip 19 is provided with a bent hook 20 at one end and also with a detent 21 at the other end. In the assembling operation, the hook 20 is first engaged in one of the apertures 18 in one of the connector plates, and the detent 21 is then inserted into the aperture 18 of the other connector plate. The spring clip 19, as best seen in FIGS. 2, 3 and 6, has a curvature facilitating the insertion of the detent when the parts are being assembled, and this curvature will vary according to the angle of the panels being connected.

In the embodiments herein illustrated, each connector or spring plate 19 is shown as having a hook at one end and a detent at the other end, but it is to be understood that the interengaging means at the ends of the connector or spring clip may take the form of a detent at both ends.

The connector plates and the spring clip comprise the components which hold the panels together at opposite sides of the joint 11, the spring clip preferably being configured so that the edges of the panels are brought together into snug engagement without clearance.

Although the connector plates and the spring clip will provide an effective connection between the two panels, as above described, the panels, being extended in a common plane or in edge-to-edge relation in somewhat inclined planes (as described hereinafter with reference to the embodiment shown in FIGS. 7, 8 and 9), would still remain free for relative shifting movement of the panels either angularly or transversely with respect to each other in the absence of some fastening means in addition to the spring clip. For this purpose, the invention provides what is herein referred to as a bridge plate. In the embodiment of FIGS. 1 to 6, this bridge plate is indicated by the reference numeral 22. It will be seen that the bridge plate comprises a channel-shaped component extended across the panel joint and into the cavities provided within the connector plates. The bridge plate also has apertures 23 formed therein and, as seen in FIG. 6, those apertures are in registry with the apertures 18 in the connector plates when the parts are assembled at the panel joint. The apertures 23 are larger than the apertures 18 in a direction transverse to the joint between the panels, the apertures 23 being positioned and proportioned so that they will not restrict or interfere with the action of the spring clip 19 in its cooperation with the apertures 18 when the spring clip is applied to complete the panel joint. The presence of the apertures 23 and the projection of the fastening elements 20 and 21 of the spring clip not only into the apertures 18 at the connector plates but also into the apertures 23 of the bridge plate serves the purpose of preventing the bridge plate from escaping by unintentional displacement out of the openings provided within the connector plates 13.

In the preferred practice of the invention, the bridge plate is desirably dimensioned in a direction perpendicularly to the panels and to the connector plates so that only very small clearance is provided between the top of the bridge plate and the under side of the connector plates. Providing only small clearance is of importance in preventing the panels from shifting in relation to each other in a direction perpendicular to the plane of the panels or in angularly tilting with respect to each other.

From the above, it will be seen that the interpositioning of the panels is effected in the edgewise direction by means of the spring clip, but is effected in other directions by means of the interfitting of the bridge plate and the connector plates.

Another aspect of the fastening devices of the present invention is illustrated in FIG. 1. In that figure, it will be noted that the wall of the carton there shown is made up of a panel 10*a*, having an area equal to one-half of the total sidewall of the carton, together with two panels 10*b*, each of which represents about one-quarter of the total area of the wall. The spring clips and connector plates of the joints serve to interconnect the three panel pieces 10*a*, 10*b* and 10*b*, but as will be realized from inspection of FIG. 1, the same parts mounted on other panel pieces lying in the same plane may alternatively be used in order to interconnect panel pieces in different arrangements. For example, four panel pieces (each representing one-quarter of the area of the wall) could be interconnected by means of the connector plates; or a wall such as indicated in FIG. 1 could be formed by means of two panel pieces such as shown at 10*a*, each comprising one-half of the wall, instead of employing the one-quarter size pieces indicated at 10*b*. Various combinations may thus be employed in accordance with the invention. In FIG. 1, 24 also indicates 90 degree corner joint fastening devices, and it will be understood that these may be constructed according to the present invention or may take any of a variety of known forms of such devices.

Figure 7:
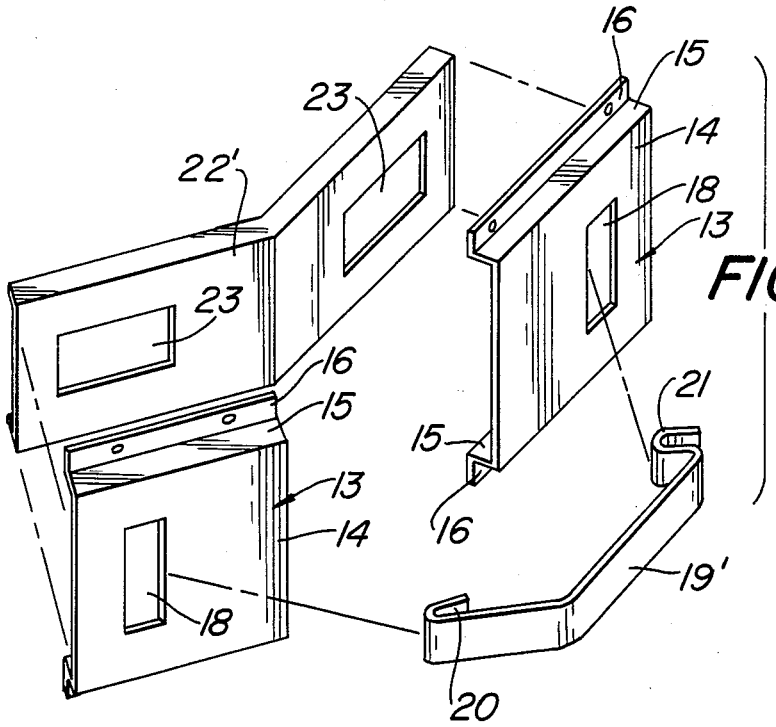
FIG. 7 is a view similar to FIG. 6 but illustrating the panel connecting components modified for application to a pair of panels lying in planes diverging somewhat from the common plane shown in FIGS. 1 to 6, inclusive.
Figure 8:
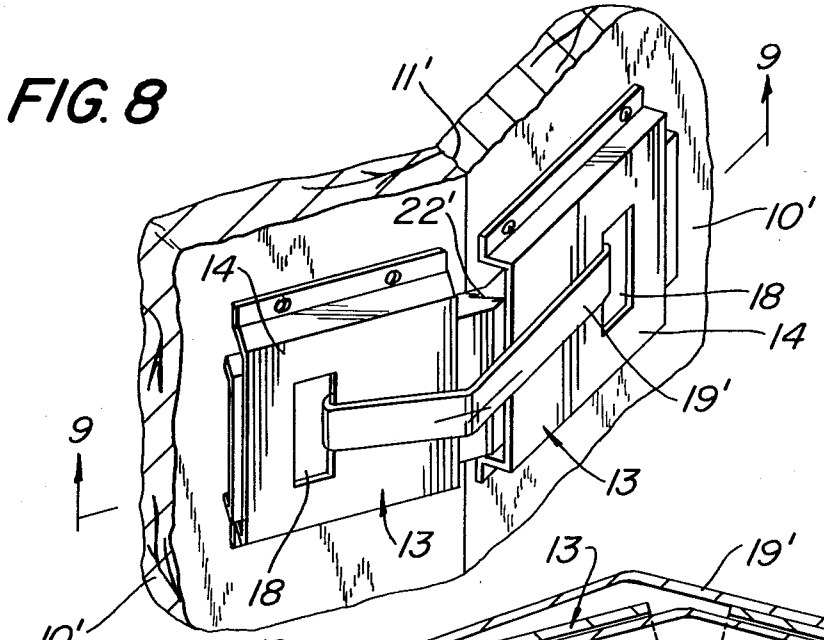
FIG. 8 is a view similar to FIG. 2 but illustrating the modified arrangement which also appears in FIG. 7.
Figure 9:
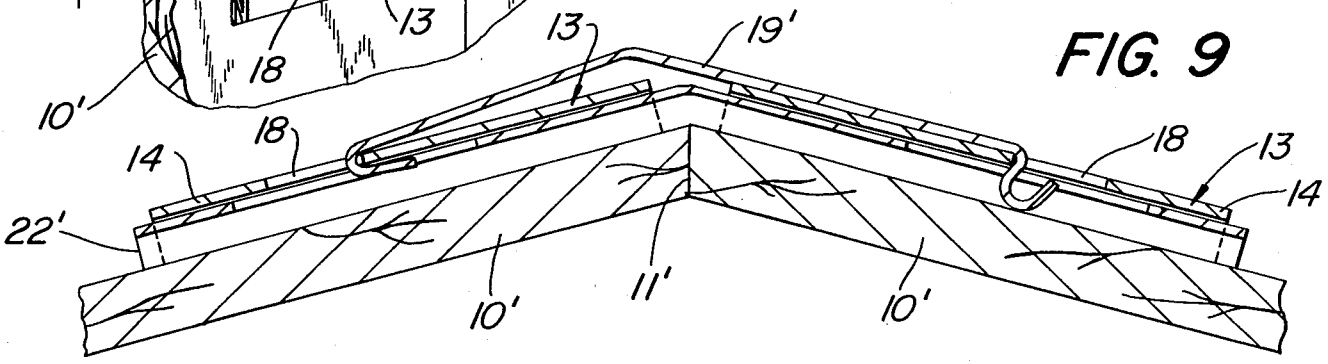
FIG. 9 is a view similar to FIG. 3 but illustrating the modified arrangement of FIGS. 7 and 8, FIG. 9 being taken as indicated by the section line 9—9 on FIG. 8.

Turning now to the embodiment illustrated in FIGS. 7, 8 and 9, it is first noted that the same reference numerals have been used for the various parts but, in certain instances where the parts are of different configuration, the part has been identified by the same number, together with a prime mark (').

As best seen in FIGS. 8 and 9, the panels 10'—10' are positioned in planes at an angle to each other and have bevelled edges providing a joint 11'. It will thus be seen that the arrangement of the invention is readily adapted to the interconnection of panels lying either in the same plane or in somewhat angled planes. Although the angle of the panels in the embodiment of FIGS. 7, 8 and 9 provides a convex configuration when viewed, as in FIG. 9, it will be understood that some angularity in the concave sense may also be accommodated by joint parts in accordance with the present invention.

It will further be understood that the configuration of the spring clip 19' in the embodiment of FIGS. 7, 8 and 9 is modified as compared with the spring clip used in the first embodiment in order to readily accommodate application and removal of the spring clip, notwithstanding the relatively angled planes of the panels being connected.

I claim:

1. A system for interconnecting panels of a carton in edge-to-edge relation, said system comprising connector plates adapted to be fastened to the panels near adjoining edges thereof, each connector plate having a wall spaced from the panel to provide a cavity adjoining the panel wall and said cavities having openings presented toward each other across the panel joint, a bridge plate extended across the panel joint with the ends of the bridge plate extended through said openings into the cavities in the connector plates, each end of the bridge plate and the associated connector plate being provided with apertures in registry with each other, and a spring clip extended across the panel joint and having fastening elements at the ends thereof, one of which projects into registered apertures of a connector plate and the bridge plate and the other one of which projects into registered apertures of the other connector plate and the bridge plate.

2. A system as defined in claim 1, in which the aperture in the bridge plate in registry with the aperture in one of the connector plates is positioned and proportioned to provide clearance with respect to the associated clip fastening element in a direction across the panel joint.

3. A system as defined in claim 1, in which the system is applied to panels lying in a common plane and in which the ends of the bridge plate also lie in a common plane.

4. A system as defined in claim 1, in which one of the fastening elements of the spring clip comprises a hook and in which the other fastening element comprises a detent.

5. A system for interconnecting panels of a carton in edge-to-edge relation, said system comprising connector plates adapted to be fastened to the panels near adjoining edges thereof, each connector plate having an aperture therein, a spring clip extended across the panel joint and having fastening elements, one of which is engaged in the aperture of one connector plate and the other of which is engaged in the aperture of the other connector plate, the spring clip and the connector plates and their apertures being proportioned to establish a snug joint between the panel edges when the spring clip is applied, and the connector plates being configured to provide cavities adjoining the panel surfaces and said cavities having openings presented toward each other across the panel joint, and a bridge plate extended across the panel joint with the ends of the bridge plate extended through said openings into the cavities in the connector plates, the dimensions of the bridge plate and of the cavities in the connector plates providing close tolerance perpendicularly of the panels thereby restricting relative panel displacement in directions transversely of the planes of the panels.

6. A system as defined in claim 5, in which the bridge plate is provided with apertures in the regions of the apertures in the connector plates, the bridge plate apertures and the connector plate apertures being relatively positioned and proportioned to provide clearance between the fastening elements of the spring clip and the structure of the bridge plate surrounding its apertures.

7. A system as defined in claim 5, in which the system is applied to panels lying in relatively angled planes and in which the end portions of the bridge plate lie in similarly relatively angled planes.

8. A system as defined in claim 5, in which the system is applied to coplanar panels and in which the end portions of the bridge plate are coplanar, the dimensions of the bridge plate and of the cavities in the connector plates providing close tolerance perpendicularly of the coplanar panels thereby restricting relative angling of the panels.

9. A system for interconnecting panels of a carton in edge-to-edge relation, said system comprising connector plates adapted to be fastened to the panels near adjoining edges thereof, a fastening clip extended across the panel joint and having means adapted to interengage with the connector plates, the interengaging means of the fastening clip and connector plates being proportioned to establish a snug joint between the panel edges when the fastening clip is applied, and the connector plates being configured to provide cavities adjoining the panel surfaces and said cavities having openings presented toward each other across the panel joint, and a bridge plate extended across the panel joint with the ends of the bridge plate extended through said openings into the cavities in the connector plates, the dimensions of the bridge plate and of the cavities in the connector plates providing close tolerance perpendicularly of the panels thereby restricting relative panel displacement in directions transversely of the planes of the panels.

10. A system as defined in claim 9, in which the bridge plate has apertures in the regions of interengagement of the fastening clip with the bridge plate, said apertures being positioned and proportioned to provide clearance with respect to the clip fastening means when interengaged with the connector plates.

* * * * *